US007255030B2

(12) United States Patent
Benjaminsson

(10) Patent No.: US 7,255,030 B2
(45) Date of Patent: Aug. 14, 2007

(54) METHOD AND DEVICE AT RUNNING WEBS HAVE BEEN PRINTED IN A HIGH-SPEED PRINTER

(75) Inventor: Peter Benjaminsson, Ljungby (SE)

(73) Assignee: Stralfors AB, Ljungby (SE)

( * ) Notice: Subject to any disclaimer, the term of this patent is extended or adjusted under 35 U.S.C. 154(b) by 223 days.

(21) Appl. No.: 10/493,773

(22) PCT Filed: Oct. 28, 2002

(86) PCT No.: PCT/SE02/01949

§ 371 (c)(1),
(2), (4) Date: Apr. 26, 2004

(87) PCT Pub. No.: WO03/037766

PCT Pub. Date: May 8, 2003

(65) Prior Publication Data

US 2004/0255738 A1 Dec. 23, 2004

(30) Foreign Application Priority Data

Oct. 29, 2001 (SE) ..... 0103578

(51) Int. Cl.
*B26D 1/01* (2006.01)

(52) U.S. Cl. ..... 83/13; 83/364; 83/368; 83/286; 83/371; 83/75; 83/74

(58) Field of Classification Search ..... 83/13, 83/72–74, 63, 286, 364–368, 371, 75; 382/108; 700/125; 242/534.1; 226/18–19
See application file for complete search history.

(56) References Cited

U.S. PATENT DOCUMENTS 3,260,142 A 7/1966 Nitchie et al.
3,325,072 A * 6/1967 Black et al. ..... 226/20
3,570,735 A * 3/1971 Kurz ..... 226/3

(Continued)

FOREIGN PATENT DOCUMENTS

EP 0 562 443 A1 9/1992

(Continued)

*Primary Examiner*—Boyer D. Ashley
*Assistant Examiner*—Laura M Lee
(74) *Attorney, Agent, or Firm*—Tarolli, Sundheim, Covell & Tummino LLP

(57) ABSTRACT

The present invention relates running webs which have been printed in a high-speed printer. A method and a device are provided for longitudinal cuffing of a running, unseparated web in two web portions, wherein the unseparated web (2) is printed in a high-speed printer (1) and wherein the unseparated web (2) is cut longitudinally in two web portions (2*a*, 2*b*). The unseparated web (2) is brought to run between a first and a second edge support (8, 9) such that longitudinal outer edges (2*d*, 2*e*), extending in the running direction (T), of the unseparated web (2) can cooperate with the edge supports (8, 9). If the width (B) of the unseparated web (2) varies and/or changes, this is read and the second edge support (9) and the cuffing means (7) are continuously controlled to move in a lateral direction (S) relative to the running direction (T) such that the unseparated web (2) is cut in two web portions (2*a*, 2*b*) with widths (B2*a*, B2*b*) which are adapted to each other.

20 Claims, 2 Drawing Sheets

U.S. PATENT DOCUMENTS 3,753,381 A * 8/1973 Reime et al. ..... 83/364
3,981,435 A 9/1976 Johnsen
4,287,471 A * 9/1981 Ko et al. ..... 324/725
4,392,910 A * 7/1983 Tokuno et al. ..... 156/361
4,611,517 A * 9/1986 Schmale ..... 83/56
4,798,136 A * 1/1989 Tittgemeyer et al. ..... 101/181
5,074,178 A * 12/1991 Shetley et al. ..... 83/47
5,452,632 A * 9/1995 Durr et al. ..... 83/13
5,489,784 A * 2/1996 Koiranen et al. ..... 250/548
5,765,460 A * 6/1998 Wathieu ..... 83/37
5,807,222 A * 9/1998 Totani ..... 493/22
5,857,392 A * 1/1999 Parkander ..... 83/72
6,018,687 A * 1/2000 Tabor ..... 700/125
6,149,565 A * 11/2000 Meyer et al. ..... 493/22
6,205,898 B1 * 3/2001 Surina ..... 83/76
6,220,134 B1 * 4/2001 Thiel et al. ..... 83/74

FOREIGN PATENT DOCUMENTS

EP 1 080 887 A1 3/2001

* cited by examiner

METHOD AND DEVICE AT RUNNING WEBS HAVE BEEN PRINTED IN A HIGH-SPEED PRINTER

FIELD OF THE INVENTION

The present invention relates to a method and a device at running webs which have been printed in a high speed printer.

BACKGROUND OF THE INVENTION

A method for manufacturing printed papers which have been printed in a high-speed printer, is known from EP 0 562 443. At this prior art method, an unseparated web is cut longitudinally in two web portions, but the method does not solve the problem that the longitudinal cut will be incorrect if the width of the unseparated web for some reason varies and/or changes.

U.S. Pat. Nos. 3,260,142 and 3,753,381 describe control devices which control the position of an outer edge of a running web and which move cutting means for dividing the web in lateral direction if said web is moved laterally. These control devices neither solve the problem that the longitudinal cutting of the web will be erroneous if the width of the web varies and/or changes.

SUMMARY OF THE INVENTION

The object of the present invention has been to provide methods and devices which solve the problem of bringing about a correct division of the web if the width thereof for some reason varies or changes and which solve the problems with a safe and efficient feeding and cutting of the web portions. This is arrived at by the methods and devices according to the invention.

Since the invention is defined by said characterizing measures and features, it is accomplished that the position of the cutting means is continuously adapted to variations and/or changes of the width of the unseparated web such that said web is cut in web portions with widths adapted to each other in dependence of said variations and/or changes. It is also accomplished that the web portions are fed and cut in a safe and efficient manner.

BRIEF DESCRIPTION OF THE DRAWINGS

The invention will be further described below with reference to the accompanying drawings, in which.

DESCRIPTION OF EXAMPLE EMBODIMENT

Figure 1:
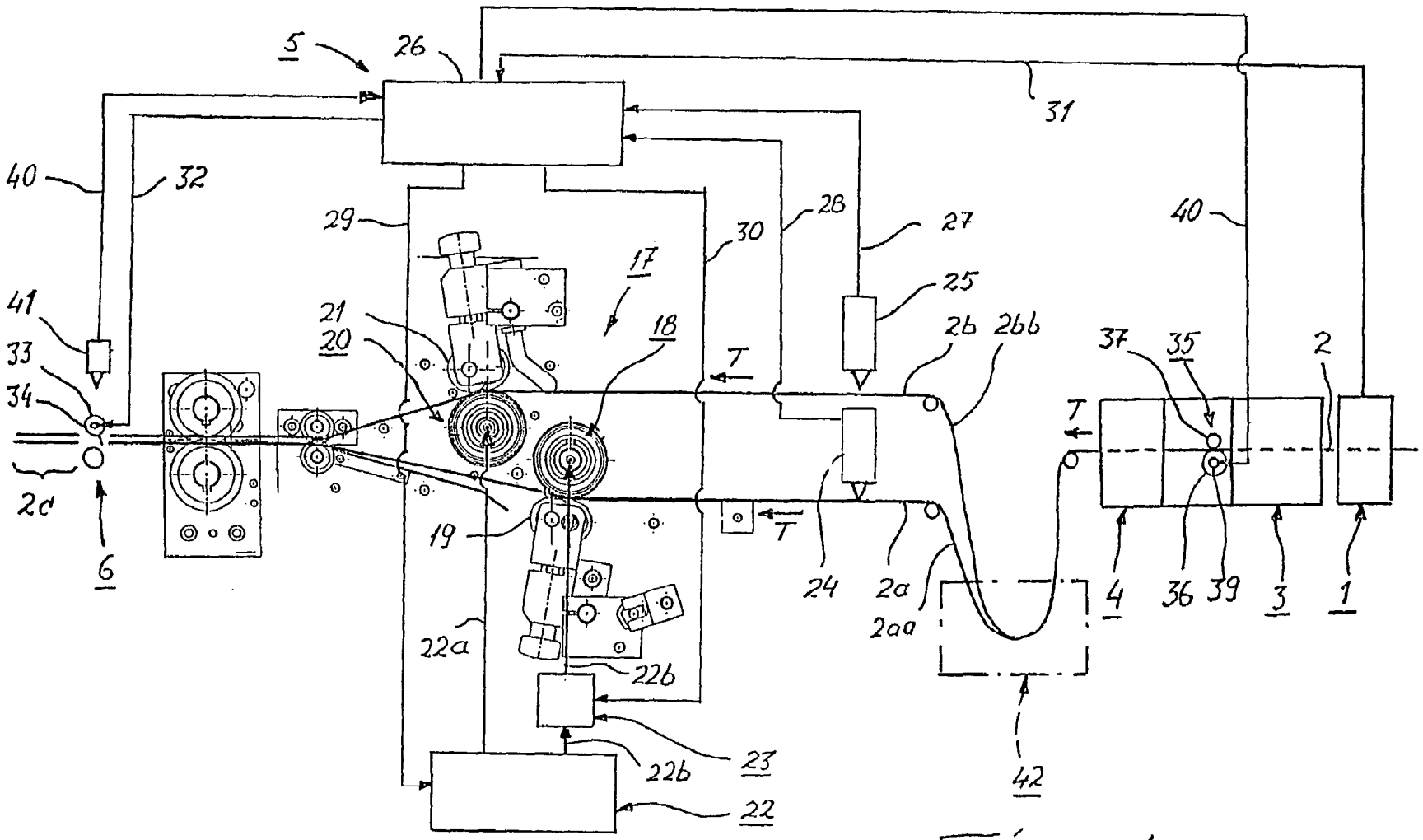
FIG. 1 with a side view schematically illustrates several devices located after each other and among which a device according to the invention constitutes a part.

The device illustrated in FIG. 1 includes a high-speed printer 1 for printing a running, unseparated web 2, a length cutting device 3 for longitudinal cutting of the web 2 in two web portions 2*a*, 2*b*, a twin-web device 4 for bringing the two web portions 2*a*, 2*b* to run above each other as a twin web, a synchronizing device 5 in order to ensure that the web portions 2*a*, 2*b* run such that parts thereof have predetermined positions relative to each other and a cross cutting device 6 for cutting the web portions 2*a*, 2*b* to double face products 2*c*.

The unseparated web 2 is preferably fed from a roll (not shown) into the high speed printer 1 and is printed therein as previously stated in a suitable manner. In connection with the printing or on another occasion, the unseparated web 2 may be provided with marks M2*a*, M2*b* in such a way that marks M2*a* will later be found on the web portion 2*a* and marks M2*b* on the web portion 2*b*. The web portions 2*a*, 2*b* shall be brought to run synchronized relative to each other such that a part of the web portion 2*a* with marks M2*a* will be found in a certain relationship to a corresponding part of the web portion 2*b* with marks M2*b*, which will be further described below.

Figure 2:
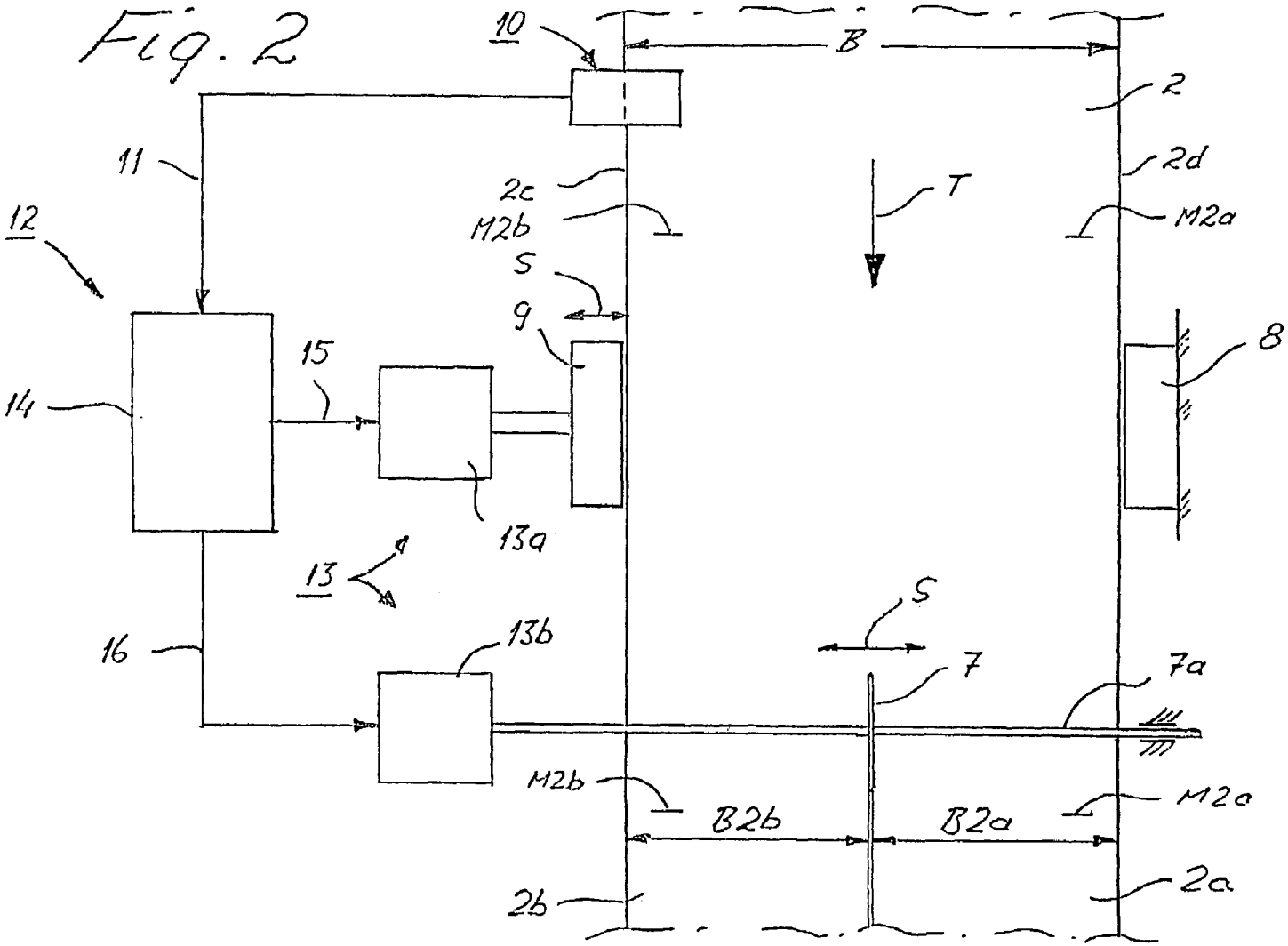
FIG. 2 with an enlarged plan view shows a device according to the invention.

As is apparent from FIG. 2, the length cutting device 3 comprises a cutting means 7 which is adapted to divide the unseparated web 2 into the web portions 2*a*, 2*b* and this is carried through continuously when the web 2 moves in the running direction T. The length cutting device 3 further comprises a first edge support 8 and a second edge support 9. The unseparated web 2 is brought to move between said edge supports 8, 9 such that the longitudinal first and second outer edges 2*d*, 2*e* thereof extending in the running direction T, cooperate with the edge supports 8, 9, which means that these supports guide the unseparated web 2 not to move laterally relative to the running direction T when it runs through the length cutting device 3.

A reader device 10 is provided for continuously reading if the width B of the running web 2 for some reason varies and/or for some reason changes. If the reader device 10 reads variations and/or changes of the width B of the unseparated web 2, it transmits change signals, arrow 11, to a control device 12 which continuously controls the second edge support 9 (which is movable in lateral directions, arrow S, relative to the running direction T) as well as the cutting means 7 (which is also movable in lateral directions S relative to the running direction T) to continuously move in said lateral directions S based on such variations and/or changes of the width B of the unseparated web 2 read by the reader device 10 such that the cutting means 7 cuts the unseparated web 2 into two web portions 2*a*, 2*b* with widths B2*a* and B2*b* adapted to each other even if the width B of the unseparated web 2 varies and/or changes.

As an example of functions of said device, it can be mentioned that if the width B of the unseparated web 2 decreases, the reader device 10 transmits corresponding change signals 11 to the control device 12 which moves the second edge support 9 correspondingly to the right and the cutting means 7 is displaced half as much to the right. If the width B of the unseparated web 2 on the other hand increases, the reader device 10 transmits corresponding change signals 11 to the control device 12 which instead moves the second edge support 9 and the cutting means 7 to the left.

The reader device 10 reads the extent or size of said variations and/or changes of the width B of the web 2 and it transmits, depending on this size, change signals 11 to the control device 12 which controls the second edge support 9 and the cutting means 7 to move a distance corresponding to said size-dependent change signals 11.

The reader device 10 is preferably provided such that it continuously reads the actual width B of the unseparated web 2 by reading the actual position of its second outer edge 2*e* relative to the first edge support 8, which preferably is fixedly mounted.

The control device 12 preferably comprises a driving device 13 for moving the second edge support 9 and the cutting means 7 relative to the first edge support 8. Said driving device 13 may include a first drive unit 13*a* for moving the second edge support 9 and a second drive unit 13*b* for moving the cutting means 7. The drive units 13*a*, 13*b* may be electric motors and they may be controlled by control signals from a control unit 14 in the control device 12. These control signals have been indicated by arrows 15 and 16 in FIG. 2.

The cutting means 7 may be rotatably mounted on a shaft 7*a* which can be displaced in lateral direction S by means of the second drive unit 13*b*. The cutting means 7 may in a manner known per se be rotatably mounted and cooperate with a drive unit rotating it. The cutting means 7 may further be provided to divide the unseparated web 2 in web portions 2*a*, 2*b* having the same width B2*a*, B2*b* and in that case it is displaced half the distance relative to the distance the width B of the unseparated web 2 is varied. However, the cutting means 7 may be provided to cut the unseparated web 2 in web portions 2*a*, 2*b* having different widths B2*a*, B2*b*.

In the twin-web device 4, the two web portions 2*a*, 2*b* are brought to run above each other as a twin web. Twin-web devices 4 for this purpose are commonly known and not further described here. It should be mentioned however, that such devices generally have edge guide plates or similar for guiding one web portion 2*b* to run above the other web portion 2*a*.

After the twin-web device 4, the web portions 2*a*, 2*b* are fed into the synchronizing device 5, which here is combined with a feed device 17. The latter may include a lower friction roll 18 for feeding the lower web portion 2*a* and this lower friction roll 18 cooperates with a counter-pressure roll 19. The feed device 17 may further include an upper friction roll 20 for feeding the upper web portion 2*b* and said upper friction roll 20 may cooperate with a counter-pressure roll 21.

The friction rolls 18, 20 are provided to perform, in cooperation with the counter-pressure rolls 19, 21, friction feeding of the web portions 2*a*, 2*b*, which means that they shall engage the web portions 2*a*, 2*b* with such friction that these are fed in the running direction T.

The friction rolls 18, 20 are in the present embodiment rotated by one and same drive unit 22 (preferably an electric motor), which is illustrated with drive lines 22*a*, 22*b*. The upper friction roll 20 is driven directly by the drive unit 22, while the lower friction roll 18 is operated by the drive unit 22 through a rotary-speed regulation device 23, e.g. a variation device or a servo regulator, which can increase or decrease the rotary speed of the friction roll 20.

The synchronizing device 5 preferably comprises a lower reader device 24 for reading the marks M2*a* on the lower web portion 2*a* and an upper reader device 25 for reading the marks M2*b* on the upper web portion 2*b*. The reader devices 24, 25 cooperate with a control unit 26 such that reading signals, schematically illustrated with arrows 27, 28, are transmitted to the control unit 26. The control unit 26 cooperates in turn with the drive unit 22 for transmitting control signals 29 thereto as well as with the rotary-speed regulating device 23 for transmitting control signals 30 thereto. The control unit 26 receives information signals 31 from the high-speed printer 1 and information signals 41*a* from the cross cutting device 6.

The synchronizing device 5 operates such that information signals 31 are transmitted from the high-speed printer 1 to the control unit 26 and from said unit as control signals 29 to the drive unit 22 which operates the friction rolls 18, 20 to rotate with a certain rotary speed and thus, the web portions 2*a*, 2*b* with a certain running speed. If the running speed of one of the web portions is changed relative to the running speed of the other web portion in an inappropriate manner, this is sensed by the reader devices 24, 25 which sense this change by determining that the marks M2*a* and M2*b* do no longer pass them at the same time or at another predetermined moment. If this situation has occurred, control signals 30 are transmitted to the rotary-speed regulating device 23 such that this device increases or decreases the rotary speed of the lower friction roll 18 relative to the rotary speed of the upper friction roll 20 and thus, operates the lower web portion 2*a* faster or slower than the upper web portion 2*b* until the web portions 2*a*, 2*b* again run relative to each other such that marks M2*a*, M2*b* again pass the reader devices 24, 25 in a predetermined manner. Hereby, it is ensured that a certain part of the lower web portion 2*a* reaches an exact position relative to a corresponding part of the upper web portion 2*b* when said parts reach the cross cutting device 6 so that they can be located in predetermined exact positions relative to each other.

The cross cutting device 6 may have a rotating cutting means 33, the driving device 34 of which is controlled such that the rotating cutting means 33 cuts the web portions 2*a*, 2*b* at the right moment for obtaining products 2*c* with the correct size. This control of the rotating cutting means 33 is carried through preferably by transmitting information signals 32 from the control unit 26 to the driving device 34 of said cutting means 33, said information signals being dependent on the marks M2*a* and/or M2*b* read on the web portions 2*a* and/or 2*b* or corresponding holes in the web portions 2*a*, 2*b*, i.e. on reading signals 27 and/or 28 transmitted by the reading devices 24 and/or 25 to the control unit 26 when they read said marks m2*a* and/or M2*b* or corresponding holes.

The reading devices 24, 25 may either be photoelectric, reading the marks M2*a*, M2*b*, or so called spiked rollers which engage said holes (not shown) in the web portions 2*a*, 2*b* and thereby read the positions of the web portions 2*a*, 2*b* relative to the various working devices.

There may also be a feeding unit 35 for feeding the web portions 2*a*, 2*b* to the twin-web device 4. This feeding unit 35 includes, in the illustrated embodiment, at least a friction roll 36 and a counter-pressure roll 37 between which the web portions 2*a*, 2*b* run or pass for transport in the running direction T.

The feeding unit 35 may further include a driving device 39 for driving the friction roll 36 or the feeding means 38. This driving device 39 may be controlled by control signals 40 from the control unit 26 and is dependent on the information signals from the high-speed printer 1.

There may also be a loop sensing device 42 known per se and sensing loops 2*aa* and 2*bb* of the web portions 2*a*, 2*b* as well as controlling means for stretching or slacking the web portions 2*a*, 2*b* in dependence of how much the loops 2*aa*, 2*bb* are hanging down.

By means of the method and device described above it is achieved that the unseparated web 2 is cut in two web portions 2*a*, 2*b*, the widths B2*a*, B2*b* of which check or agree exactly with each other also if the width B of the unseparated web 2 varies and/or changes. The unseparated web 2 may vary and/or change for many reasons. If e.g. the unseparated web 2 is a paper web, the width B thereof may be changed because the degree of moisture in the web is changed. The invention further permits safe and effective feeding and cutting of the web portions 2*a*, 2*b*.

The invention is not limited to the method and device described above, but may vary within the scope of the subsequent claims. As examples not described in more detail it should be mentioned that the web 2, instead of a paper web, may be a plastic web or a web of another material. The unseparated web 2 can be cut in more than two web portions and it may be cut in two web portions 2*a*, 2*b* having different widths B2*a*, B2*b*. The extent of the displacement of the cutting means 7 may vary and depend on the desired widths B2*a*, B2*b* of the two web portions 2*a*, 2*b*. The cutting means 7 is preferably a rotating roller and it can be displaced laterally S on the shaft 7*a* instead of moving the shaft 7*a* laterally together with the cutting means 7. It should finally be mentioned that said sensing devices may be photosensors or other types of sensors. The cross cutting device 6 may be of another type than rotating and said signals can be control and/or information signals.

The invention claimed is:

1. Method for longitudinal cutting of a running, unseparated web in at least two web portions, wherein the unseparated web (2) is printed in a high-speed printer (1), and wherein the unseparated web (2) is cut longitudinally in at least said two web portions (2*a*, 2*b*) by means of a cutting mean (7), characterized in that the unseparated web (2) is brought to run between a first and a second edge support (8, 9) such that longitudinal outer edges (2*d*, 2*e*) of the unseparated web (2), extending in the running direction (T), can cooperate with said edge supports (8, 9), that at least when the width (B) of the unseparated web (2) varies and/or changes, this variation and/or change is read, and that the second edge support (9) and the cutting means (7) are continuously controlled to move in a lateral direction (S) relative to the running direction (T) of the unseparated web (2) and in dependence of said continuously read variations and/or changes of the width (B) of the unseparated web (2), such that incorrect cutting of the running, unseparated web (2) is avoided if the width (B) thereof varies and/or changes.

2. Method according to claim 1, characterized in that continuous reading of the width (B) of the unseparated web (2) is carried through by continuously reading the position of the second longitudinal outer edge (2*e*) of the unseparated web (2) relative to the first edge support (8) and that, if variations and/or changes of the width (B) of the unseparated web (2) is determined by a change of the position of the second longitudinal outer edge (2*e*) of the unseparated web (2) relative to the first edge support (8), the position of the second edge support (9) as well as of the cutting means (7) relative to the first edge support (8) is continuously changed in dependence of the extent or size of the read variations and/or changes of the width (B) of the unseparated web (2).

3. Method according to claim 1, characterized in that the unseparated web (2) is cut in at least two web portions (2*a*, 2*b*) with the same width (B2*a*, B2*b*) and that the cutting means (7) is moved relative to the first edge support (8) in dependence of read variation and/or change of the width (B) of the unseparated web (2) such that the cutting means (7) cuts the unseparated web (2) in two web portions (2*a*, 2*b*) with the same width (B2*a*, B2*b*)

4. Method according to claim 1, characterized in that the unseparated web (2) is brought to run between a first fixed edge support (8) and a second edge support (9) which is movable in a lateral direction (S) relative to the running direction (T) of the unseparated web (2).

5. Method according to claim 1, characterized in that changes of the position of one outer edge (2*e*) of the unseparated web (2) relative to the first edge support (8) are read continuously by means of a reader device (10), that change signals (11) are transmitted from the reader device (10) to a control device (12), whereby the change signals (11) are depending on changes of the extent or size of variations and/or changes of the position of said outer edge (2*e*), that control signals (15) are transmitted to a driving device (13), forming part of the control device (12), for moving the second edge support (9) relative to the first edge support (8) in dependence of the size or magnitude of said change signals (11) and that control signals (16) are transmitted to the driving device (13), forming part of the control device (12), for moving or displacing the cutting means (7) relative to the first edge support (8) in dependence of the size or magnitude of said change signals (11).

6. Method according to claim 5, characterized in that the cutting means (7) is moved relative to the first edge support (8) by displacement by means of the driving device (13) of a shaft (7*a*) on which the cutting means (7) is provided.

7. Method according to claim 1, wherein the web portions (2*a*, 2*b*) are brought to run above each other, characterized in that marks (M2*a*, M2*b*) or holes in the web portions (2*a*, 2*b*) are read, that at least one friction roll (18, 20) is controlled to measure each web portion (2*a*, 2*b*) in dependence of said reading and that the web portions (2*a*, 2*b*) are cut to double face products (2*c*) in dependence of said reading.

8. Method according to claim 7, characterized in that the running speed of a web portion (e.g. 2*a*) is regulated relative to the running speed of another web portion (e.g. 2*b*) if marks (M2*a*, M2*b*) on the various web portions (2*a*, 2*b*), when read, do not pass predetermined locations at predetermined times.

9. Method according to claim 7, characterized in that at least one friction roll (36) for feeding the web portions (2*a*, 2*b*) to a twin-web device (4) wherein the web portions (2*a*, 2*b*) are provided to run above each other as a twin web, is controlled in dependence of control signals (40) from a high-speed printer (1).

10. Method according to claim 7, characterized in that the friction rolls (18, 20) for feeding the web portions (2*a*, 2*b*) are driven by one and the same drive unit (22), that a friction roll (18) for feeding a web portion (e.g. 2*a*) is driven by the drive unit (22) through a rotary-speed regulating device (23) which increases or decreases the rotary speed of said one friction roll (e.g. 18) relative to the rotary speed of the other friction roll (e.g. 20) and brings thereby one web portion (e.g. 2*a*) to run at a higher or lower running speed than the other web portion (e.g. 2*b*) for restoring deviations in the running speeds of the web portions (2*a*, 2*b*) and thereby the mutual positions of parts belonging to each other of said web portions (2*a*, 2*b*).

11. Device for longitudinal cutting of a running, unseparated web in at least two web portions, wherein the unseparated web (2) is printed in a high-speed printer (1), and wherein at least one cutting mean (7) is provided to cut the unseparated web (2) longitudinally in at least said two web portions (2*a*, 2*b*), characterized in that the device comprises a first and a second edge support (8, 9) between which the unseparated web (2) is brought to run in the running direction (T) such that longitudinal outer edges (2*d*, 2*e*) of the unseparated web (2) can cooperate with said edge supports (8, 9), that a reader device (10) is provided to continuously read if the width (B) of the unseparated web (2) varies and/or changes, and that a control device (12) is provided to continuously control the second edge support (9) and the cutting means (7) to continuously move in lateral directions (S) relative to the running direction (T) in dependence of such variations and/or changes of the width (B) of the unseparated web (2) which have been read by the reader device (10), so that incorrect cutting of the running, unseparated web (2) is avoided if the width (B) thereof varies and/or changes.

12. Device according to claim 11, characterized in that the reader device (10) is provided to continuously read the width (B) of the unseparated web (2) by continuously reading the position of a second outer edge (2*e*) of the unseparated web (2) relative to the first edge support (8), that the reader device (10) is provided to transmit change signals (11) to the control device (12), said change signals (11) being dependent on the extent or size of variations and/or changes of the width (B) of the unseparated web (2), and that the control device (12) is provided to control, in dependence of said size-dependent change signals (11), the second edge support (9) as well as the cutting means (7) to adapt their positions to the varied and/or changed width (B) of the unseparated web (2).

13. Device according to claim 12, characterized in that the control device (12) includes a driving device (13) which is provided to move the second edge support (9) as well as the cutting means (7) in a lateral direction (S) relative to the running direction (T) of the unseparated web (2) and relative to the first edge support (8).

14. Device according to claim 13, characterized in that the driving device (13) comprises a first drive unit (13*a*) for moving the second edge support (9) relative to the first edge support (8) and a second drive unit (13*b*) for moving the cutting means (7) relative to the first edge support (8).

15. Device according to claim 14, characterized in that the cutting means (7) is provided on a shaft (7*a*) and that the second drive unit (13*b*) is provided to displace said shaft (7*a*) in a lateral direction (S) relative to the running direction (T) of the unseparated web (2).

16. Device according to claim 11, characterized in that the cutting means (7) is provided to divide the unseparated web (2) into two web portions (2*a*, 2*b*) having the same width (B2*a*, B2*b*) and that the control device (12) is provided to control the cutting means (7) such that said cutting means (7), when the width (B) of the unseparated web (2) varies and/or changes, is moved in dependence of said change so that it cuts the unseparated web (2) in two web portions (2*a*, 2*b*) with the same width (B2*a*, B2*b*).

17. Device according to claim 11, wherein the web portions (2*a*, 2*b*) in a twin-web device (4) are brought to run above each other as a twin web, characterized in that other reader devices (24, 25) are provided to read marks (M2*a*, M2*b*) on the web portions (2*a*, 2*b*) in order to a) control friction rolls (18, 20) which are adapted to feed the web portions (2*a*, 2*b*) in a running direction (T) in dependence of said reading, and b) control a cross cutting device (6) for cutting the web portions (2*a*, 2*b*) to products (2*c*) in dependence of said reading.

18. Device according to claim 17, characterized in that at least one drive unit (22) is provided to operate the friction rolls (18, 20), that the sensing devices (24, 25) are provided to sense when marks (M2*a*, M2*b*) or holes in the two web portions (2*a*, 2*b*) pass in order to determine if parts belonging to each other of the web portions (2*a*, 2*b*) are in correct relationship to each other and to transmit reading signals (27, 28) if this is not the case, that the drive unit (22) is provided to transfer generated rotary motions directly to one (20) of the friction rolls (18, 20) and transfer said rotary motions to the other (18) of said friction rolls (18, 20) through a rotary-speed regulating device (23) which is provided between the drive unit (22) and said other friction roll (18) for increasing or decreasing the rotary speed of said latter friction roll (18) relative to a rotary speed of said first friction roll (20) and that the rotary-speed regulating device (23) is controlled by control signals (30) which are dependent on said reading signals (27, 28) for increasing or decreasing the rotary speed of one friction roll (e.g. 18) such that deviations in the running speeds of the web portions (2*a*, 2*b*) and thus, deviations in the mutual positions of the parts belonging to each other of said web portions (2*a*, 2*b*) are restored.

19. Device according to claim 17, characterized in that at least one friction roll (36) in a feeding unit (35) is provided to feed the web portions (2*a*, 2*b*) to the twin-web device (4) and that said friction roll (36) is controlled by control signals (40) from the high-speed printer (1).

20. Device according to claim 17, characterized in that the cross cutting device (6) comprises a rotating cutting means (33).

* * * * *